US010711680B2

(12) United States Patent
Maki et al.

(10) Patent No.: US 10,711,680 B2
(45) Date of Patent: Jul. 14, 2020

(54) METHOD OF FORMING AN INTERNAL COMBUSTION ENGINE WITH A FLUID JACKET

(71) Applicant: Ford Global Technologies, LLC, Dearborn, MI (US)

(72) Inventors: Clifford E. Maki, New Hudson, MI (US); Antony George Schepak, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 245 days.

(21) Appl. No.: 15/785,649

(22) Filed: Oct. 17, 2017

(65) Prior Publication Data

US 2018/0038264 A1 Feb. 8, 2018

Related U.S. Application Data

(62) Division of application No. 14/813,544, filed on Jul. 30, 2015, now Pat. No. 9,797,293.

(51) Int. Cl.

| | |
|---|---|
| ***F02F 1/00*** | (2006.01) |
| ***F01P 3/02*** | (2006.01) |
| ***F02F 1/10*** | (2006.01) |

(52) U.S. Cl.

CPC ..... *F01P 3/02* (2013.01); *F02F 1/004* (2013.01); *F02F 1/10* (2013.01); *F01P 2003/021* (2013.01)

(58) Field of Classification Search

CPC ..... F01P 3/02; F01P 2003/021; F02F 1/10; F02F 1/004; F02F 1/14; F02F 1/40

See application file for complete search history.

(56) References Cited

U.S. PATENT DOCUMENTS

| | | | | |
|---|---|---|---|---|
| 4,730,579 | A | 3/1988 | Yamada et al. | |
| 4,759,317 | A | 7/1988 | Ampferer | |
| 4,813,408 | A | 3/1989 | Katsumoto et al. | |
| 5,080,049 | A | 1/1992 | Solomon et al. | |
| 5,253,615 | A | 10/1993 | Heater et al. | |
| 5,529,027 | A | 6/1996 | Okubo | |
| 6,354,357 | B1 * | 3/2002 | Clark | B22C 7/023 164/137 |

(Continued)

FOREIGN PATENT DOCUMENTS

| | | | |
|---|---|---|---|
| CN | 204041253 | U | 12/2014 |
| CN | 104454214 | A | 3/2015 |

(Continued)

OTHER PUBLICATIONS

Chinese Office Action and English translation for Application No. 201610621103.9, dated Aug. 28, 2019, 8 pages.

*Primary Examiner* — Ryan J. Walters
(74) *Attorney, Agent, or Firm* — Brooks Kushman P.C.; Geoffrey Brumbaugh

(57) ABSTRACT

An engine has a cylinder block with a deck face and at least one cylinder liner with a cylinder axis. The block has a first fluid jacket about the liner, a second fluid jacket about the liner, and a third fluid jacket about the liner. The first, second, and third fluid jackets are fluidly independent from one another and spaced apart from one another along the cylinder axis. A method for forming the engine includes using an insert to provide each of the fluid jackets. The insert has a lost core material surrounded by a metal shell.

20 Claims, 6 Drawing Sheets

(56) References Cited

U.S. PATENT DOCUMENTS

| | | | | |
|---|---|---|---|---|
| 6,575,124 | B2 * | 6/2003 | Shimizu | F02F 1/108 123/41.79 |
| 7,225,786 | B2 * | 6/2007 | Kim | B22C 9/103 123/195 R |
| 8,869,758 | B1 | 10/2014 | Beyer et al. | |
| 2010/0175641 | A1 | 7/2010 | Yamada | |
| 2011/0114041 | A1 | 5/2011 | Hamakawa et al. | |
| 2013/0199749 | A1 * | 8/2013 | Moschini | B22C 9/10 164/529 |
| 2016/0040621 | A1 * | 2/2016 | Beyer | B22C 9/106 123/193.1 |

FOREIGN PATENT DOCUMENTS

| | | | |
|---|---|---|---|
| CN | 204436556 | U | 7/2015 |
| JP | 11061485 | A | 3/1998 |
| JP | 5063449 | B2 | 10/2012 |
| SU | 1703846 | A1 | 1/1992 |

* cited by examiner

METHOD OF FORMING AN INTERNAL COMBUSTION ENGINE WITH A FLUID JACKET

CROSS-REFERENCE TO RELATED APPLICATIONS

This application is a division of U.S. application Ser. No. 14/813,544 filed Jul. 30, 2015, now U.S. Pat. No. 9,797,293 B2, the disclosure of which is hereby incorporated in its entirety by reference herein.

TECHNICAL FIELD

Various embodiments relate to a cooling jacket and cooling system for an internal combustion engine, and a method of forming the engine.

BACKGROUND

Internal combustion engines have associated fluid systems for cooling and lubrication. Often the fluid jackets or passages are integrally formed within the cylinder block (or crankcase) and/or cylinder head of the engine. The shape of the jacket and passages may be dependent on or limited by the manufacturing method used to form them.

For example, with a conventional die casting process and an open deck cylinder block, the cylinder block may be formed using free standing cylinder liners with the inner bores connected in a siamese configuration and a cooling jacket surrounding the liners. The cooling jacket typically has a smooth contour and is limited in its depth to fit between the head bolt column and bore wall. The draft angle on the cooling jacket is uniform and straight to allow for the dies to open after casting. This draft angle and the manufacturing process does not allow for a complex structure in the jacket to create flow dynamics for coolant mixing while coolant flows through the jacket. Additionally, the casting process typically does not allow for the formation of interbore cooling passages, and the like, and these passages are typically formed after casting using a machining process such as drilling.

In another example, in a conventional sand casting process, the cylinder block may be formed with an open deck or a closed deck. The sand casting process may limit the shape of fluid jackets, as the sand forms may be required to have certain minimum thicknesses to survive the casting process. Sand casting may also limit the arrangement of the deck face around the cylinders and head bolt columns. For example, if the interbore bridge is less than twelve millimeters, a sand cast interbore cooling passage will not be able to be packaged within the space.

The manufacturing processes, and resulting fluid jacket structure, may limit the control of the flow characteristics, control over heat transfer, and control over the engine temperature. For example, the cooling jacket may limit the control over the temperature and thermal gradient in the cylinder wall, bore wall, or liner.

A fluid jacket formed using a mono blade in a one contiguous shape with a die casting produces a water jacket that may not allow for reduced volumes and features that do not allow fluid to flow in a layered parallel path, nor allow a uniform bore wall temperature to be realized. This may also be said about a sand cast produced water jacket.

SUMMARY

In an embodiment, an engine is provided with a cylinder block having a deck face and a cylinder liner with a cylinder axis. The block defines a first fluid jacket about the liner, a second fluid jacket about the liner, and a third fluid jacket about the liner. The first, second and third fluid jackets are fluidly independent from one another and spaced apart from one another along the cylinder axis.

In another embodiment, an engine is provided with a cylinder block having a deck face, a first cylinder liner extending along a cylinder axis, and a second cylinder liner adjacent to the first liner. The block defines a first fluid jacket associated with the first and second liners, and a second fluid jacket associated with the first and second liners. The first and second fluid jackets are fluidly independent from one another and spaced apart from one another along the cylinder axis.

In yet another embodiment, a method of forming an engine block is provided. A set of inserts is formed, with each insert having a lost core material coated in a metal shell. The lost core material is configured to provide a fluid jacket. Each insert has a first member configured to provide an inlet passage, a second member configured to provide an outlet passage, and a plurality of cylindrical members extending between the first and second members and configured to provide liner cooling passages. A plurality of cylinder liners are positioned adjacent to one another on a casting tool. The set of inserts are stacked about the plurality of liners with each insert spaced apart from an adjacent insert. Each cylindrical member of each insert is positioned about a respective cylinder liner, and the liners are positioned between the first and second members of each insert. The engine block is cast about the plurality of lines and the set of insert. The lost core material is removed from the cast engine block to form the fluid jacket.

Various embodiments of the present disclosure have associated non-limited advantages. For example, a series of stacked fluid jackets may be provided in an engine block around cylinder liners to improve heat transfer characteristics for the engine. The fluid jackets provide fluid or cooling circuits that pull heat away from the bore or liner wall while mixing with the surrounding bulk coolant in the jacket. The jackets provide separate coolant circuits layered or stacked along the cylinder wall length to provide the enhanced control over heat transfer and the bore wall temperature. The fluid velocities and/or flow rates in each jacket may be controlled to correspond with the heat energy and rejection rate caused by combustion events in the cylinders. The coolant flowing through the block has a parallel flow design layout with a cross flow strategy to provide a controlled, substantially even temperature over the cylinder wall surfaces. By providing an even cylinder wall or cylinder liner temperature, dynamic bore distortion from uneven temperatures like the inter-bore bridge to the bottom of a bore may be reduced. Additionally, the flow velocity may be independently controlled through each jacket and cooling circuit. By forming the jackets in place, the shape of the jackets may be controlled and provide a reduced water jacket volume to increase the heat energy mass flow rates of the system while allowing for a uniform bore wall temperature. The engine and its associated systems performance increases with uniform or substantially uniform bore wall temperatures, as can be seen from both reduced fuel consumption and reduced engine emissions during a normal drive cycle.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
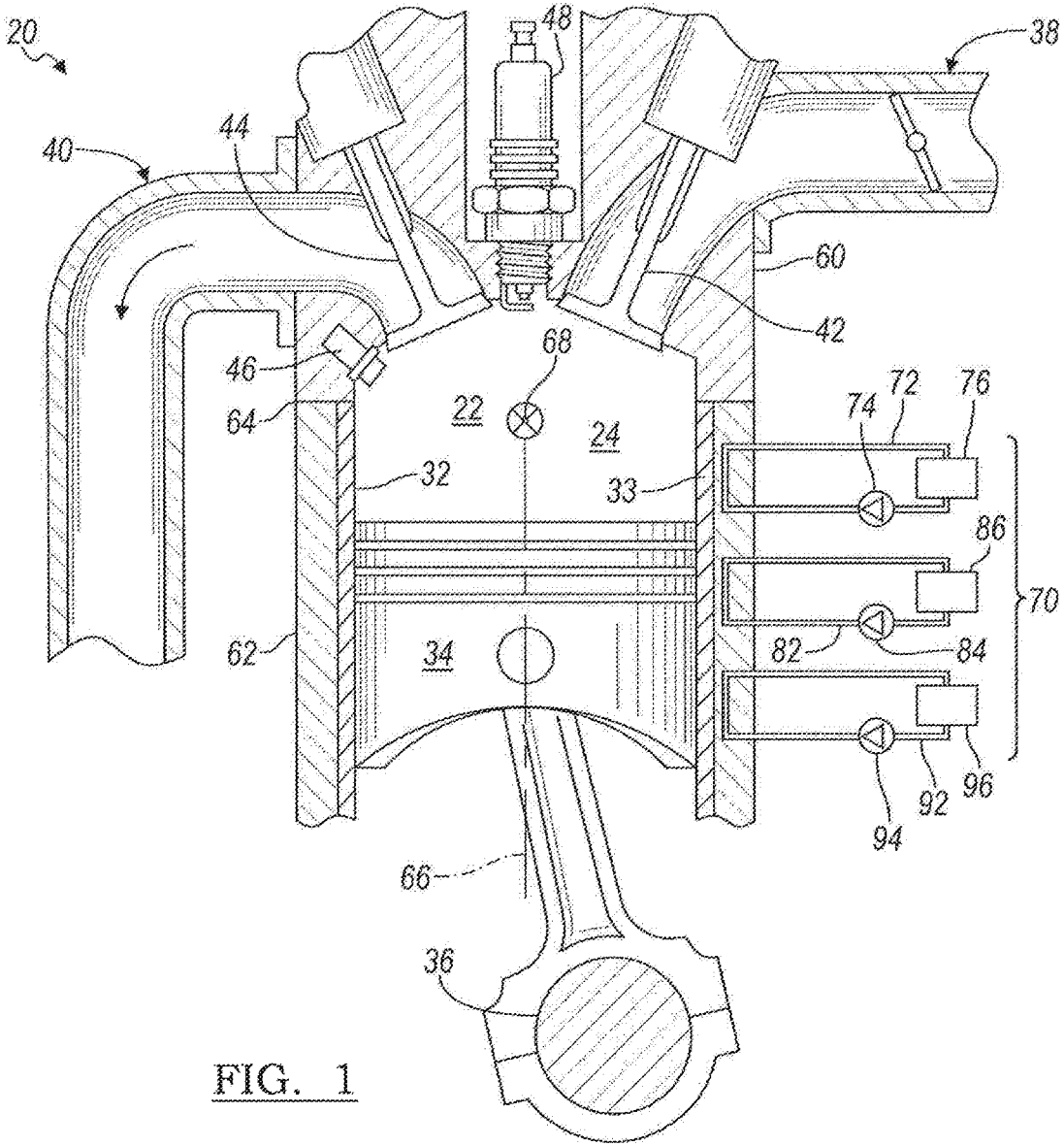
FIG. 1 illustrates a schematic of an internal combustion engine according to an embodiment.

FIG. 1 illustrates a schematic an internal combustion engine 20. The engine 20 has a plurality of cylinders 22, and one cylinder is illustrated. In one example, the engine 20 is an in-line four cylinder engine, and, in other examples, has other arrangements and numbers of cylinders. In one example, the cylinders may be arranged in a siamesed configuration. The cylinder block may have an open deck, a semi-open deck, or a closed deck configuration. The engine 20 block and cylinder head may be cast from aluminum, an aluminum alloy, or another metal. In another example, the engine 20 block and/or cylinder head may be cast or molded from a composite material, including a fiber reinforced resin, and other suitable materials.

The engine 20 has a combustion chamber 24 associated with each cylinder 22. The cylinder 22 is formed by cylinder walls 32 and piston 34. The cylinder walls 32 may be formed by a cylinder liner 33, and the cylinder liner may be a different material than the block, or the same as the block. In one example, the liner 33 is a ferrous material while the remainder of the engine 20 block and head is generally provided by aluminum, an aluminum alloy, or a composite material.

The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor), an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. In other examples, the engine 20 may operate as a two-stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 has a cylinder head 60 that is connected to a cylinder block 62 or a crankcase to form the cylinders 22 and combustion chambers 24. A head gasket 64 is interposed between the cylinder block 62 and the cylinder head 60 to seal the cylinders 22. Each cylinder 22 is arranged along a respective cylinder axis 66. For an engine with cylinders 22 arranged in-line, the cylinders 22 are arranged along the longitudinal axis 68 of the block.

The engine 20 has one or more fluid systems 70. In the example shown, the engine 20 has three fluid systems 72, 82, 92 with associated jackets in the block 62, although any number of systems is contemplated. The systems or jackets 72, 82, 92 may be identical or substantially similar to one another, or may be formed with different shapes and passages. The systems 72, 82, 92 may be separate from one another such that they are standalone systems and are fluidly independent of one another. In a further example, the systems 72, 82, 92 may each contain a different fluid. Note that in the present disclosure a fluid may refer to a liquid, vapor, or a gas phase; and the fluid may include coolant and/or lubricants, including water, oil, and air. In other examples, two or more of the systems 72, 82, 92 may be fluidly connected; however, various features such as valves and the like may be used to separately control flow through each jacket within the engine block.

The engine 20 has a first fluid system 72 that may be at least partially integrated with a cylinder block 62 and/or a cylinder head 60. The fluid system 72 has a jacket in the block 62 and may act as a cooling system, a lubrication system, and the like. In the example shown, the fluid system 72 is a cooling jacket and is provided to remove heat from the engine 20. The amount of heat removed from the engine 20 may be controlled by a cooling system controller or the engine controller. The fluid system 72 has one or more fluid jackets or circuits that may contain water, another coolant, or a lubricant as the working fluid. In the present example, the first system 72 contains water or a water based coolant. The fluid system 72 has one or more pumps 74, and a heat exchanger 76 such as a radiator. The pump 74 may be mechanically driven, e.g. by a connection to a rotating shaft of the engine, or may be electrically driven. The system 72 may also include valves, thermostats, and the like (not shown) to control the flow or pressure of fluid, or direct fluid within the system 72 during engine operation.

The engine 20 has a second fluid system 82 that may be at least partially integrated with a cylinder block 62 and/or a cylinder head 60. The fluid system 82 has a jacket in the block 62 and may act as a cooling system, a lubrication system, and the like. In the example shown, the fluid system 82 is a cooling jacket and is provided to remove heat from the engine 20. The amount of heat removed from the engine 20 may be controlled by a cooling system controller or the engine controller. The fluid system 82 has one or more fluid circuits that may contain water, another coolant, or a lubricant as the working fluid. In the present example, the second system 82 contains air or another coolant. The fluid system 82 has one or more pumps 84, and a heat exchanger 86 or an outside air inlet. The pump 84 may be a compressor or a fan, and may be mechanically driven, e.g. by a connection to a rotating shaft of the engine, or may be electrically driven. The system 82 may also include valves (not shown) to control the flow or pressure of fluid, or direct fluid within the system 82 during engine operation.

The engine 20 has a third fluid system 92 that may be at least partially integrated with a cylinder block 62 and/or a cylinder head 60. The fluid system 92 has a jacket in the block 62 and may act as a cooling system, a lubrication system, and the like. In the example shown, the fluid system 92 is a lubrication jacket and is provided to remove heat from the engine 20 and/or for heating of the lubricant during a cold start operation of the engine. The system 92 may be controlled by a system controller or the engine controller. The fluid system 92 has one or more fluid circuits that may contain water, another coolant, or a lubricant as the working fluid. In the present example, the third system 92 contains a lubricant, such as engine oil. The fluid system 92 has one or more pumps 94, and a heat exchanger 96. The pump 94 may be mechanically driven, e.g. by a connection to a rotating shaft of the engine, or may be electrically driven. The system 92 may also include valves (not shown) to control the flow or pressure of fluid, or direct fluid within the system 92 during engine operation. The system 92 may also include various passages to provide lubricant to moving or rotating components of the engine for lubrication.

Various portions and passages in the fluid systems and jackets 70 may be integrally formed with the engine block and/or head as described below. Fluid passages in the fluid systems 70 may be located within the cylinder block 62 and may be adjacent to and at least partially surrounding the cylinder liners 33, cylinders 22, and combustion chambers 24. Flow through each of the jackets 72, 82, 92 may be separately and independently controlled. In one example, flow may be controlled to a specified general constant flow rate, and the flow rate may be selected based on the temperature of the engine, temperature of the fluid, and/or operating state of the engine. In another example, flow may be controlled in a "flood and dump" strategy where the fluid flows into the jackets in the block, stays generally stagnant in the block for a specified time period, and then drains or exits the block. This may be used during an engine cold start to raise the temperature of the lubricant to its operating temperature.

In one example, during an engine cold start, the third system 92 is controlled using a flood and dump strategy to heat the lubricant for the engine. The first system 72, adjacent to the upper, hottest region of the combustion chamber may be controlled to a specified flow rate to prevent hot spots. The second system 82 may be controlled to a specified flow rate, or may be not operated to allow the engine 20 to warm up.

As the engine warms up, the flow rates of the fluid in each system 72, 82, 92 may be independently controlled based on the fluid temperature, engine operating conditions, ambient conditions and the like to control the temperature of the engine and the systems.

Figure 2:
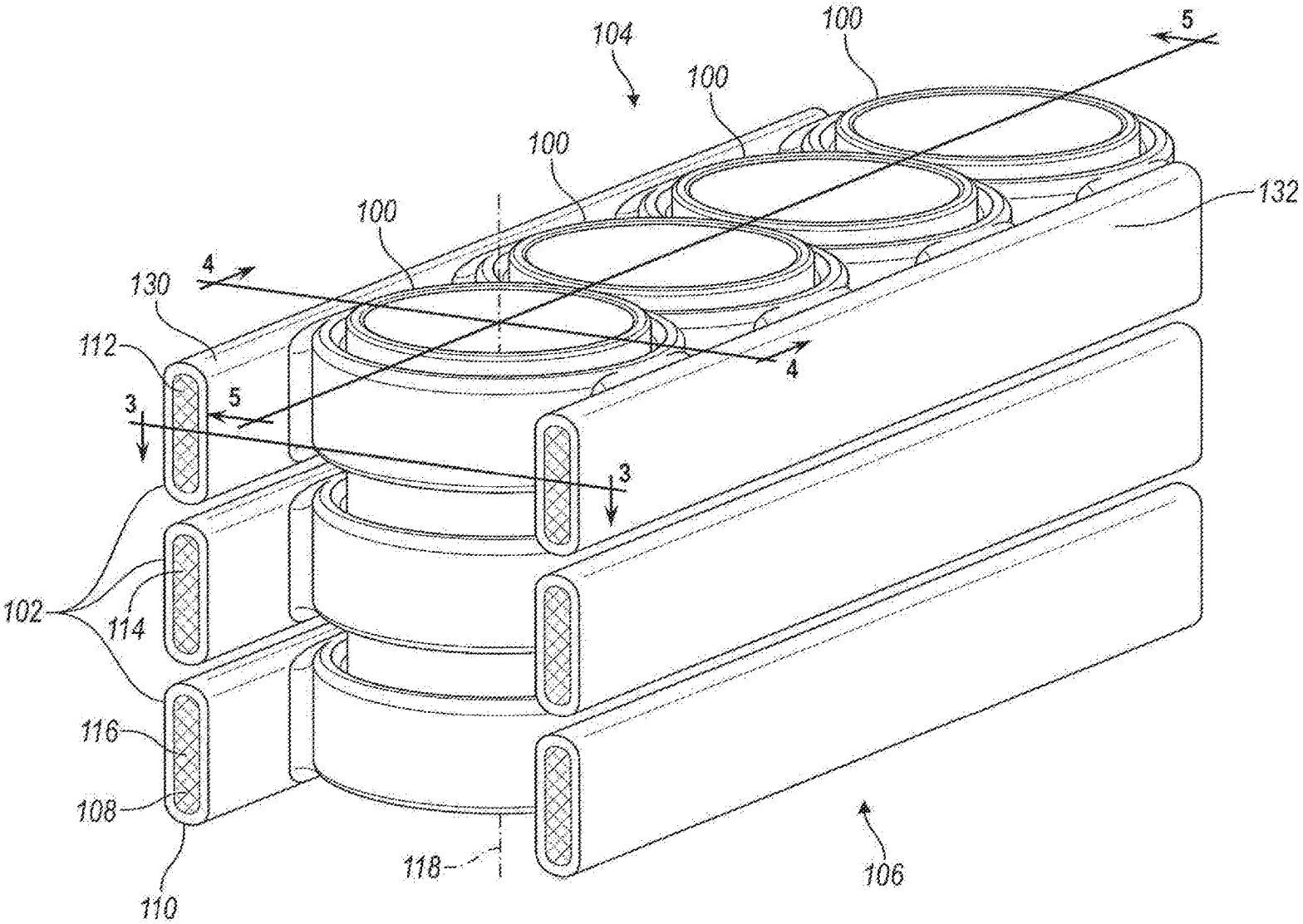
FIG. 2 illustrates a perspective view of core inserts and liners for use in forming an engine block for the engine of FIG. 1 according to an embodiment.

FIG. 2 illustrates a perspective view of a set of liners 100 and lost core inserts 102 used to form an engine block, such as the engine block 62 as shown in FIG. 1. As can be seen in the figure, the liners 100 are arranged as an in-line four-cylinder configuration, although other configurations are also contemplated. The block may be cast, molded, or otherwise formed around the liners 100 and inserts 102. The top of the block is indicated by arrow 104 which is associated with the deck face of the block. Arrow 106 indicates the side of the block that is opposed to the deck face side 104, and which may be associated with the crankshaft. The deck face 104 may be a closed deck face, a semi-closed deck face, or an open deck face. In the example shown, the block is configured as a closed deck face.

Each core insert 102 may be formed with a lost core or salt core material 108 surrounded by a shell 110. Additional details of the insert 102, and a method of forming the block is provided below with reference to FIG. 6.

One of the inserts 102 forms a first fluid jacket 112 that directs a fluid from an associated fluid system 72 about the liners 100. Another of the inserts 102 forms a second fluid jacket 114 that directs the fluid from an associated fluid system 82 about the liners 100. Yet another of the inserts 102 forms a third fluid jacket 116 that directs a fluid from an associated fluid system 92 about the liners 100.

As can be seen in FIG. 2, the jackets 112, 114, 116 are spaced apart from one another along a cylinder axis 118. In one example, cylinder axis 118 corresponds with axis 66 in FIG. 1. The inserts 102, and corresponding jackets 112, 114, 116, are stacked about the cylinder liners 100. The jackets 112, 114, 116 may be fluidly independent from one another. The inserts 102 are shown in FIGS. 2-5 as being substantially similar to one another; however, the shapes and sizes of each jacket 112, 114, 116 may vary from one another based on the heat transfer requirements and other considerations.

As can be seen in the Figure, the first jacket 112 is positioned adjacent to the deck face 104 of the block. The first jacket 112 is positioned between the deck face and the second jacket 114. The second jacket 114 is positioned between the first jacket 112 and the third jacket 116. Flow in one jacket may be parallel to the flow in the other jackets.

Figure 3:
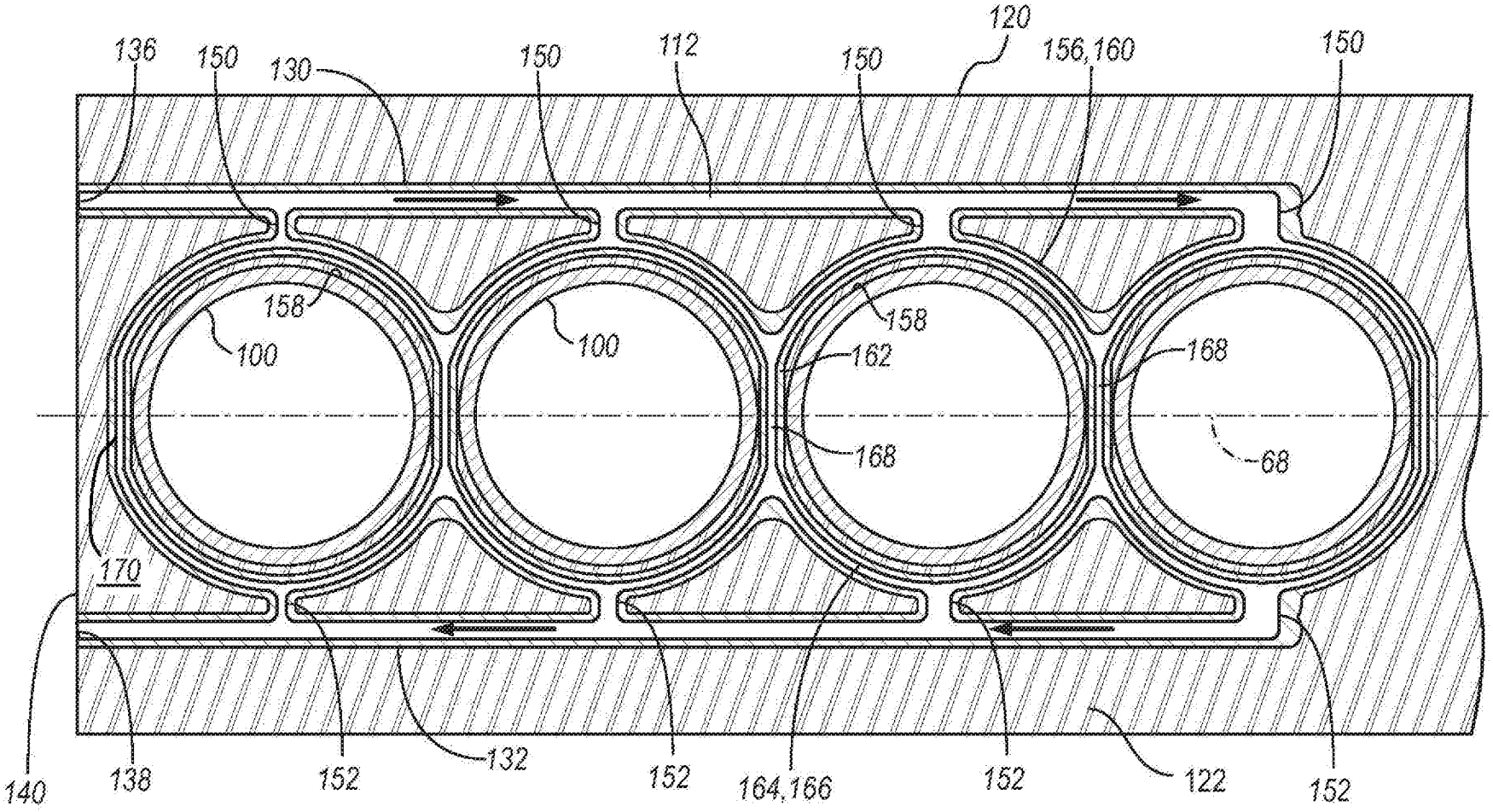
FIG. 3 illustrates a sectional view of an engine block formed for the engine of FIG. 1 and using the inserts of FIG. 2.
Figure 4:
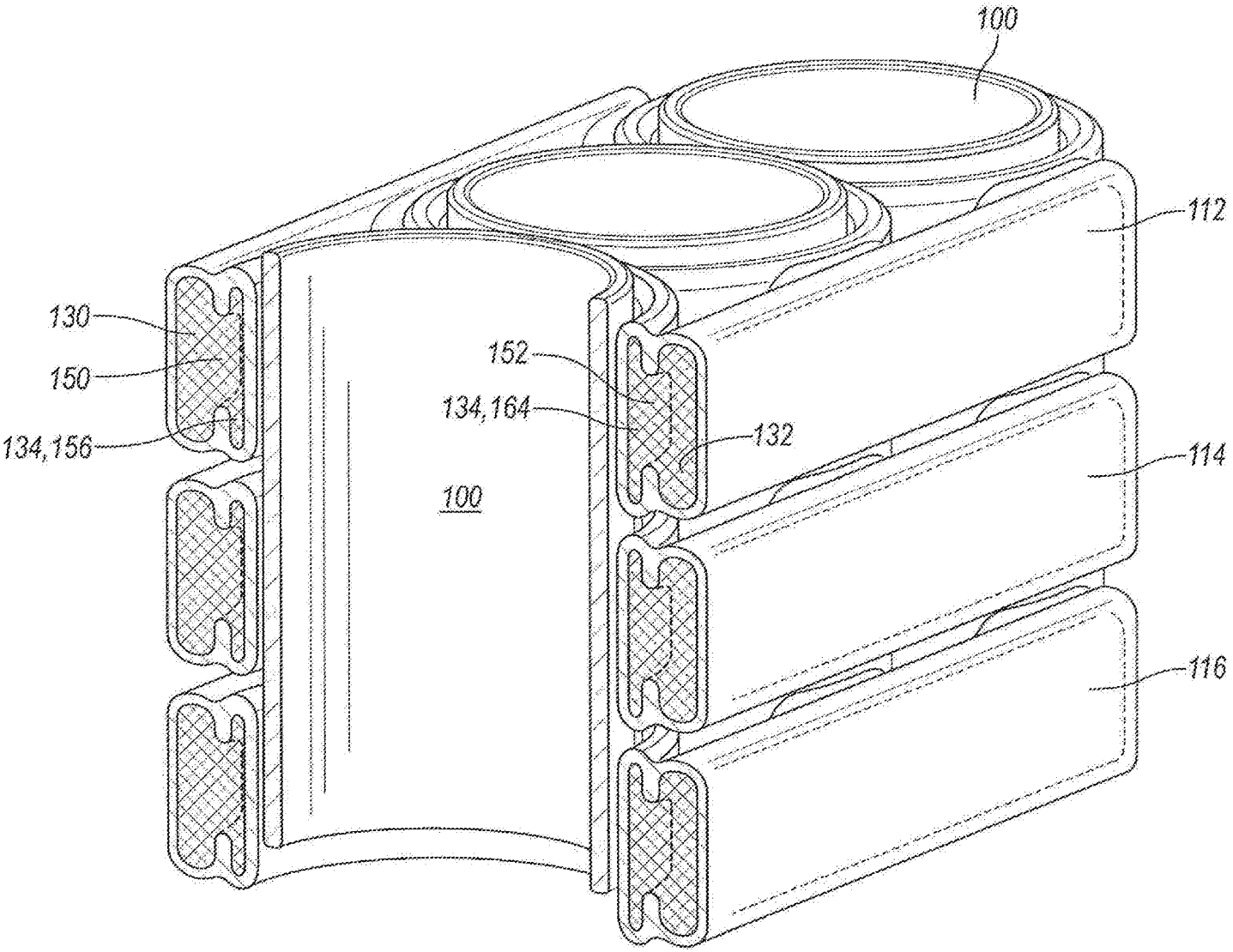
FIG. 4 illustrates another sectional view of the core inserts and liners of FIG. 2.
Figure 5:
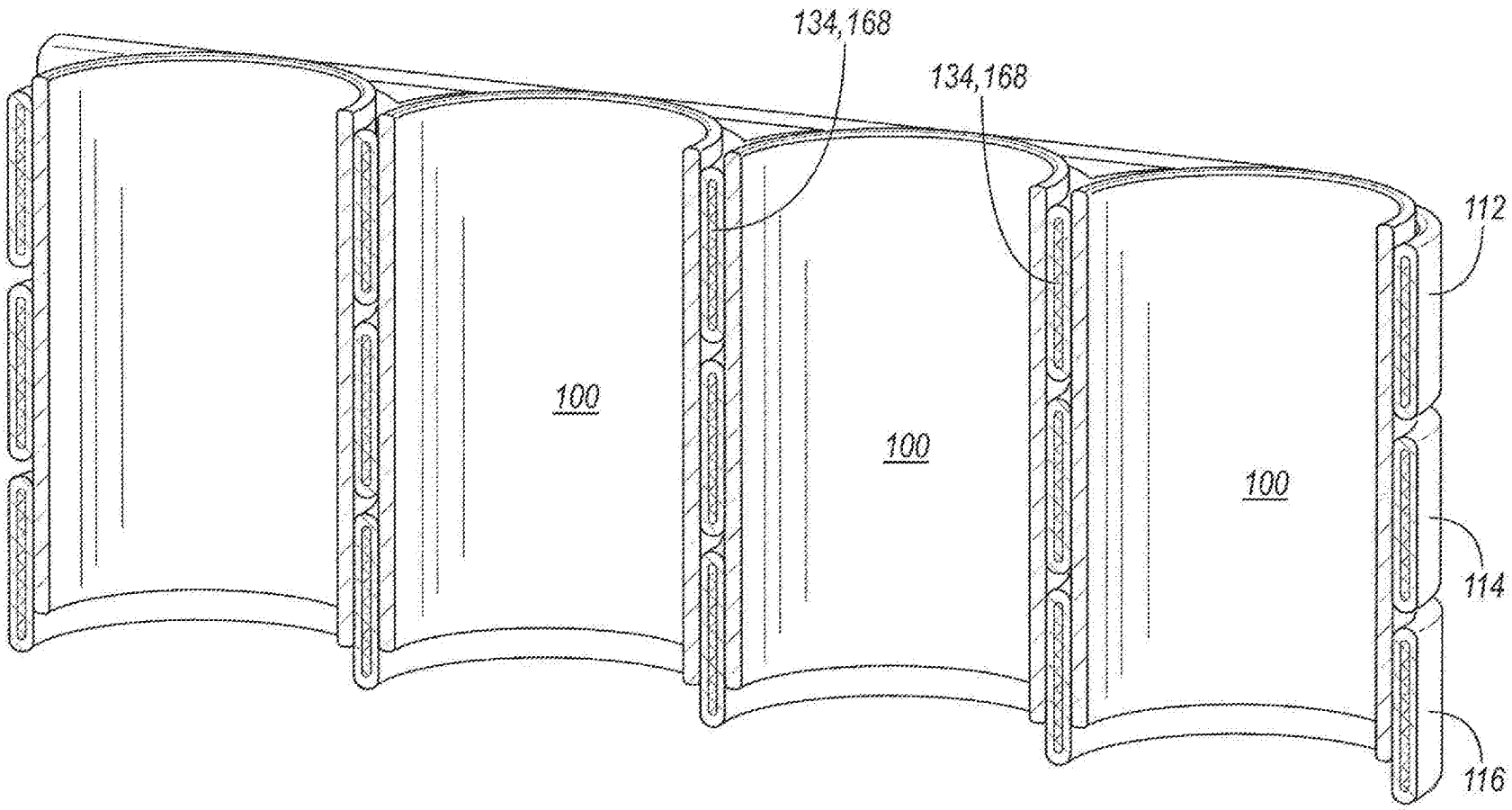
FIG. 5 illustrates yet another sectional view of the core inserts and liners of FIG. 2.

FIG. 3 illustrates a cross-sectional view taken through first fluid jacket 112. FIG. 3 is shown as a cross-sectional view of a finished block 62. The block 62 had an exhaust side 120 and an intake side 122. The exhaust side 120 of the engine is the side associated with the exhaust manifold 40. The intake side 122 of the engine is the side associated with the intake manifold 38. In other embodiments, the exhaust and intake sides 120, 122 may be oriented otherwise with respect to the fluid jacket 112. Fluid jackets 114, 116 provide a similar cross-sectional view as FIG. 3, and the description below with respect to jacket 112 also applies to jackets 114, 116.

The jacket 112 has an inlet passage 130 extending longitudinally along a first side of the block, such as exhaust side 120. The jacket 112 also has an outlet passage 132 extending longitudinally along a second opposed side of the block, such as intake side 122. The jacket 112 has a liner cooling passage 134 or web of passages surrounding the liners 100. The liner cooling passage 134 fluidly connects the inlet passage 130 and the outlet passage 132. The jacket 112 is shaped for cross flow across the block.

The fluid jacket 112 has an inlet port 136 for the inlet passage 130. The jacket 112 also has an outlet port 138 for the outlet passage 132. In the example shown, the inlet port 136 and the outlet port 138 are provided on a common end face 140 of the block, although other configurations are also contemplated.

The liner cooling passage 134 is fluidly connected to the inlet passage 130 via a series of passages 150. Each passage 150 may be positioned adjacent to a respective liner 100. Each passage 150 may be positioned along a centerline of the adjacent liner 100 as shown. In other embodiments, the passages 150 may be offset, angled, or otherwise positioned relative to the liner 100 and the liner cooling passage 134 to control the flow characteristics of the fluid in the jacket.

Each passage 150 in the series of passages may have the same cross sectional area, or may have a different cross sectional area. In the present example, the cross sectional areas of the passages 150 increase the further they are downstream in the inlet passage 130. For example, the cross sectional area of the passage 150 adjacent to the end face 140 of the block may be the smallest, with the area of the passages increasing along axis 68, or to the right in FIG. 3. This allows for control over the fluid distribution and flow to various regions of the liner cooling passage 134. In one example, the areas of each passage 150 in the series may be selected to provide substantially equal flow rates through the passages 150 and to the liners 100, or may be selected to provide higher flow rates to associated cylinders with typically higher operating temperatures, such as the middle cylinders, with lower flow rates provided to the end cylinders.

The liner cooling passage 134 is fluidly connected to the outlet passage 132 via a series of passages 152. Each passage 152 may be positioned adjacent to a respective liner 100. Each passage 152 may be positioned along a centerline of the adjacent liner 100 as shown. The passages 152 may be aligned with the passages 150 in one example. In other embodiments, the passages 152 may be offset, angled, or otherwise positioned relative to the liner 100, the liner cooling passage 134, and passages 150 to control the flow characteristics of the fluid in the jacket.

Each passage 152 in the series of passages may have the same cross sectional area, or may have a different cross sectional area. In the present example, the cross sectional areas of the passages 152 decrease the further they are downstream in the outlet passage 132. For example, the cross sectional area of the passage 152 adjacent to the end face 140 of the block may be the smallest, with the area of the passages decreasing along axis 68, or to the left, in FIG. 3. This allows for control over the fluid distribution and flow from the liner cooling passage 134. In one example, the areas of each passage 152 in the series may be selected to provide substantially equal flow rates through the passages, or may be selected to provide higher flow rates from associated cylinders with typically higher operating temperatures, such as the middle cylinders, with lower flow rates provided from the end cylinders.

The fluid enters the jacket through the inlet port 136, and flows along the inlet passage 130, as shown by the arrow. The fluid then flows through the passages 150 and into the liner cooling passage 134. From the liner cooling passage 134, the fluid flows through the passages 152, to the outlet passage 132, and the outlet port 138, as shown by the arrow.

In one example, as shown in FIG. 3, the liner cooling passage 134 is shown as a single integrated cooling passage that forms a web around the series of liners 100 and is shaped to provide fluid mixing to enhance heat transfer with the liners 100 and block. The liner cooling passage 134 has a first curved portion 156 that follows the outer surfaces 158 or perimeters of the liners 100 on one side of the engine block, with the engine block divided into two sides based on a plane extending through axis 68. The first curved portion in the present example is provided on the exhaust side 120 of the block. The curved portion 156 has an arc region 160 that is associated with each liner 100. The arc regions 160 of adjacent liners meet or intersect with one another adjacent to an interbore region 162 of the liners 100.

The liner cooling passage 134 has a second curved portion 164 that follows the outer surfaces 158 or perimeters of the liners 100 on the opposed side of the engine block based on a plane extending through axis 68. The second curved portion 164 in the present example is provided on the intake side 122 of the block. The curved portion 164 has an arc region 166 that is associated with each liner 100. The arc regions 166 of adjacent liners meet or intersect with one another adjacent to an interbore region 162 of the liners 100.

The liner cooling passage 134 has a series of interbore passages 168 that extends through the interbore region 162 between adjacent liners 100. The interbore passages 168 fluidly connect the first and second curved portions 156, 164. A passage 170 may be provided on each end of the liner cooling passage to connect the first and second curved portions 156, 164, and in the example shown, has dimensions substantially similar or the same as the interbore passages 168.

In another example, the liner cooling passage 134 is provided by a plurality of cylindrical sections or passages, and these cylindrical sections may overlap or intersect to form the interbore passages 168 as described.

The passages 168, 170 may have a smaller cross-sectional area than the first and second curved portions 156, 164 to fit within the available package space and also provide increased flow velocity through the passages 168, 170 to increase heat transfer.

Referring back to FIG. 2, the inlet passages of each fluid jacket are parallel or substantially parallel with one another. Likewise the outlet passages of each fluid jacket are parallel or substantially parallel with one another. Packaging considerations and the like may cause the passages to vary with respect to one another.

The liner cooling passages 134 of each jacket 112, 114, 116 may have the same volume or substantially the same volume as is shown in the Figures. In other examples, the volumes of the liner cooling passages 134 of each of the jackets 112, 114, 116 may be different from one another, for example, based on the desired heat transfer characteristic.

As can be seen in the Figures, the jackets 112, 114, 116 are associated with the liners 100 and are spaced apart from one another along the cylinder axis 66. The jackets 112, 114, 116 may be fluidly independent from one another, such that fluid from one jacket does not mix with fluid from another jacket, or fluid from one jacket does not travel to another jacket. As can be seen in the Figures, the jackets 112, 114, 116 may not have any connecting passages within the block such that they remain independent.

Figure 6:
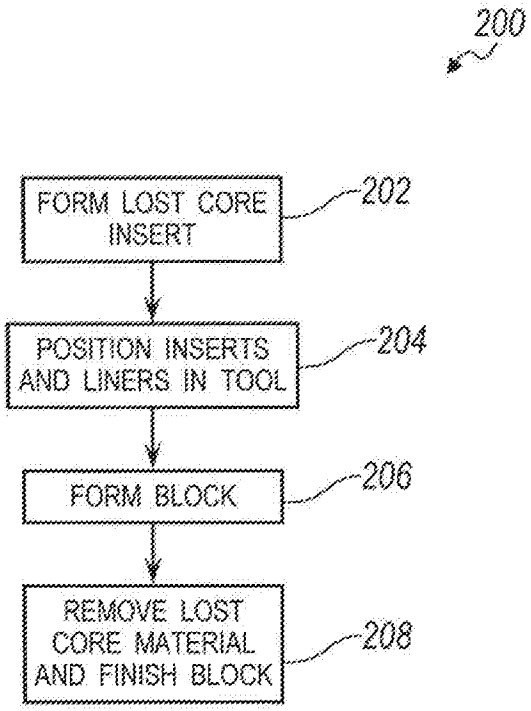
FIG. 6 illustrates a flow chart for a method of forming the engine of FIG. 1 according to an embodiment.

FIG. 6 illustrates a process or a method 200 of forming an engine block according to an embodiment. The method 200 may include greater or fewer steps than shown, the steps may be rearranged in another order, and various steps may be performed serially or simultaneously according to various examples of the disclosure.

The process 200 begins at step 202 where an insert 102 is formed or provided. An example of an insert is illustrated in FIG. 2 with reference to the inserts 102 associated with each jacket 112, 114, 116. The insert 102 is formed before use with the tool to die cast or mold the block. The insert 102 includes a lost core region 108. A shell 110 surrounds or encapsulates the lost core 108 such that it covers at least a portion of the outer surface of the lost core 108. The shell 110 may completely encapsulate the core 108, or may cover a portion of the core 108. If a region of the core 108 is left uncovered, it does not interact with the injected material during formation of the engine block to prevent destruction of the core. The lost core 108 may be a salt core, a sand core, a glass core, a foam core, or another lost core material as appropriate. The core 108 is provided generally in the desired shape and size of the respective fluid jacket 112, 114, 116.

To form the insert 102, the lost core 108 is formed in a predetermined shape and size. The shell 110 is then provided around the core 108. In one example, a die casting or casting process is used to form the shell 110 while maintaining the integrity of the core 108. A die, mold, or tool may be provided with the shape of the insert 102. The core 108 is positioned within the die, and the shell 110 is cast or otherwise formed around the core 108. The shell 110 may be formed by a low pressure casting process by injecting molten metal or another material into the mold. The molten metal may be injected at a low pressure between 2-10 psi, 2-5 psi, or another similar low pressure range using a gravity feed. The material used to form the shell 110 may be the same metal or metal alloy as used to form the block, or may be a different material from the engine block. In one example, the shell 110 is formed from aluminum or an aluminum alloy and the block is formed from aluminum, an aluminum alloy, a composite material, a polymer, and the like. By providing the molten metal at a low pressure, the lost core 108 retains its desired shape and is retained within the shell 110. After the shell 110 cools, the insert 102 is ejected from the tool and may be ready for use.

After the insert is formed at step 202, the inserts 102 for the respective jackets 112, 114, 116 are inserted and positioned within a tool at step 204, and various dies, slides or other components of the tool are moved to close the tool in preparation for an injection or casting process. In one example, cylinder liners 100 are positioned adjacent to one another on a tool. A set of inserts 102 are stacked about the liners with each insert spaced apart from an adjacent insert. In one example, the tool is provided as a tool for a high pressure die casting process of metal, such as aluminum or an aluminum alloy. In another example, the tool is provided as a tool for an injection molding process, for example, of a composite material, a polymer material, a thermoset material, a thermoplastic material, and the like.

After the tool is closed with the inserts 102 and liners 100 positioned and constrained in the tool, material is injected or otherwise provided to the tool at step 206 to generally form the engine block.

In one example, the material is a metal such as aluminum, an aluminum alloy, or another metal that is injected into the tool as a molten metal in a high pressure die casting process. In a high pressure die casting process, the molten metal may be injected into the tool at a pressure of at least 20,000 pounds per square inch (psi). The molten metal may be injected at a pressure greater than or less than 20,000 psi, for example, in the range of 15,000-30,000 psi, and may be based on the metal or metal alloy in use, the shape of the mold cavity, and other considerations.

The molten metal flows into the tool and into contact with the outer shell 110 of the insert 102 and forms a casting skin around the insert 102. The shell 110 of the insert may be partially melted to meld with the injected metal. Without the shell 110, the injected molten metal may disintegrate or deform the lost core 108. By providing the shell 110, the core 108 remains intact for later processing to form the passages and jackets, and allows for small dimensional passages such as the interbore passages to be formed.

The molten metal cools in the tool to form the engine block, which is then removed from the tool as an unfinished component.

In another example, the material is a composite or polymer material that is injected into the tool in an injection molding or other molding or forming process. The injection process may occur at a high pressure, and the tool may be heated and/or cooled as a part of the process to set the injected material. The material is injected and flows into the tool and into contact with the outer shell 110 of the insert 102. The outer shell 110 protects the lost core material from being destroyed, deformed or changed by the injected material. The outer shell 110 may provide a skin adjacent to the injected material during the molding process. The outer shell 110 may additionally be provided with a coating or surface roughness to form a bond with the injected material as it solidifies. The outer shell 110 may enhance heat transfer with a composite block as it has a higher thermal conductivity. The outer shell 110 may also aid in fluid containment when used with a composite block, as the composite material may have a porous structure or fibers that may wick fluids otherwise.

The engine block, is removed from the tool at step 208, and any finish work is then conducted. The process in step 206 may be a near net shape casting or molding process such that little post-processing work needs to be conducted.

In the present example, the insert 102 remains in the unfinished component after removal from the tool. The casting skin surrounds the lost core material. The casting skin may contain at least a portion of the shell 110. A surface of the component may be machined to form the deck face of the block, for example, by milling.

The lost core may be removed using pressurized fluid, such as a high pressure water jet or other solvent. In other examples, the lost core 108 may be removed using other techniques as are known in the art. The lost core 108 is called a lost core in the present disclosure based on the ability to remove the core in a post die casting or post molding process. The lost core in the present disclosure remains intact during the die casting or molding process due to the shell surrounding it. After the core 108 has been removed, the skin or outer shell 110 provides the wall and shape of the fluid jackets as described for the formed engine block.

By using the insert 102 structure as described, the features may be provided within a finished engine block with precision, accuracy, and control over complex geometry and small dimensions, i.e. on the order of millimeters. This allows for the formation of passages with small dimensions in difficult to position locations, such as the interbore passages. Additionally, the use of the inserts 102 allows for a stacked fluid jacket structure for the engine block, which provides greater control over the engine temperature and engine systems. The stacked jackets structure also allows for the jackets to remain enclosed by the block in a closed deck engine, and separate from one another in the block, which reduces or eliminates fluid cross-contamination and leakage issues.

Various embodiments of the present disclosure have associated, non-limited advantages. For example, a series of stacked fluid jackets may be provided in an engine block around cylinder liners to improve heat transfer characteristics for the engine. The fluid jackets provide fluid or cooling circuits that pull heat away from the bore or liner wall while mixing with the surrounding bulk coolant in the jacket. The jackets provide separate coolant circuits layered or stacked along the cylinder wall length to provide the enhanced control over heat transfer and the bore wall temperature. The fluid velocities and/or flow rates in each jacket may be controlled to correspond with the heat energy and rejection rate caused by combustion events in the cylinders. The coolant flowing through the block has a parallel flow design layout with a cross flow strategy to provide a controlled, substantially even temperature over the cylinder wall surfaces. By providing an even cylinder wall or cylinder liner temperature, dynamic bore distortion from uneven temperatures like the inter-bore bridge to the bottom of a bore may be reduced. Additionally, the flow velocity may be independently controlled through each jacket and cooling circuit. By forming the jackets in place, the shape of the jackets may be controlled and provide a reduced water jacket volume to increase the heat energy mass flow rates of the system while allowing for a uniform bore wall temperature. The engine and its associated systems performance increases with uniform or substantially uniform bore wall temperatures, as can be seen from both reduced fuel consumption and reduced engine emissions during a normal drive cycle.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method of forming an engine block comprising:

forming a set of inserts, each insert having a lost core material coated in a metal shell, the lost core material shaped to form a fluid jacket, each insert having a first member shaped to form an inlet passage, a second member shaped to form an outlet passage, and a plurality of cylindrical members extending between the first and second members and shaped to form liner cooling passages;

positioning a plurality of cylinder liners adjacent to one another on a casting tool;

stacking the set of inserts about the plurality of liners with each insert spaced apart from an adjacent insert, each cylindrical member of each insert positioned about a respective cylinder liner, and the liners positioned between the first and second members of each insert;

casting the engine block about the plurality of liners and the set of inserts; and removing the lost core material of each insert of the set of inserts from the cast engine block to form the fluid jackets.

2. The method of claim 1 wherein the set of inserts comprises a first, second and third insert such that the block is formed with a first, second and third fluid jacket.

3. The method of claim 2 wherein each insert is spaced apart from an adjacent insert such that each fluid jacket is fluidly independent.

4. The method of claim 3 wherein each insert is spaced apart from an adjacent insert along a cylinder axis of one of the plurality of cylinder liners.

5. The method of claim 1 wherein each insert of the set of inserts is formed by forming the first member, the second member and the plurality of cylindrical members from the lost core material such that the first member, the second member, and the plurality of cylindrical members are interconnected.

6. The method of claim 5 wherein each insert is formed with the first member and second member extending longitudinally.

7. The method of claim 5 wherein each insert of the set of inserts is formed by casting the metal shell about the first member, the second member, and the plurality of cylindrical members formed from the lost core material.

8. The method of claim 7 wherein the metal shell is cast to encapsulate the first member, the second member, and the plurality of cylindrical members.

9. The method of claim 7 further comprising positioning the first member, the second member, and the plurality of cylindrical members formed from the lost core material into another casting tool provided with the shape of the corresponding insert prior to casting the metal shell.

10. The method of claim 7 wherein the metal shell is cast using a low pressure die casting process by injecting molten metal into the another casting tool at a pressure of 2-10 psi.

11. The method of claim 10 wherein the engine block is cast using a high pressure die casting process by injecting molten metal into the casting tool at a pressure of 15,000-30,000 psi.

12. The method of claim 1 further comprising machining a deck face on the cast engine block configured to mate with a cylinder head.

13. The method of claim 1 wherein the metal shell of each insert is formed from a first material; and wherein the engine block is cast from a second material.

14. The method of claim 13 wherein the first and second materials are provided by one of a common metal and a common metal alloy.

15. A method of forming an engine block comprising:

stacking a first, second, and third insert about a plurality of cylinder liners in a tool with each insert spaced apart from an adjacent insert, each insert having metal shell encapsulating a lost core material shaped to define an associated fluid jacket;

injecting material into the tool to form an engine block; and removing the lost core material of the first, second and third inserts to form a first, second, and third fluid jacket, respectively, with each fluid jacket being fluidly independent.

16. The method of claim 15 wherein stacking, injecting, and removing are performed sequentially.

17. The method of claim 15 further comprising forming each insert prior to stacking by forming a lost core material into a plurality of cylindrical members positioned between and connected to first and second longitudinal members, and casting a metal shell to encapsulate the lost core material.

18. The method of claim 17 wherein the first member is shaped to form an inlet passage, the second member is shaped to form an outlet passage, and each cylindrical member is shaped to form a cylinder liner cooling passage.

19. The method of claim 15 wherein injecting material further comprises injecting one of a polymer and a composite material into the tool to surround the metal shell of each insert and the plurality of cylinder liners and form the engine block.

20. The method of claim 15 wherein injecting material further comprises injecting a molten metal into the tool to surround the metal shell of each insert and the plurality of cylinder liners and form the engine block.

* * * * *